US006996847B2

(12) United States Patent
Anderson et al.

(10) Patent No.: US 6,996,847 B2
(45) Date of Patent: Feb. 14, 2006

(54) VERSATILE GARMENT

(76) Inventors: Douglas D. Anderson, 583 Shoshone, Grand Junction, CO (US) 81509; Seth I. Anderson, 1412 Ouray Ave., Grand Junction, CO (US) 81501

( * ) Notice: Subject to any disclaimer, the term of this patent is extended or adjusted under 35 U.S.C. 154(b) by 430 days.

(21) Appl. No.: 10/079,118

(22) Filed: Feb. 20, 2002

(65) Prior Publication Data

US 2003/0154536 A1 Aug. 21, 2003

(51) Int. Cl.
*A41D 13/08* (2006.01)

(52) U.S. Cl. ..... 2/16; 2/158

(58) Field of Classification Search ..... 2/125, 2/69, 268, 270, 158, 159, 115, 247, 59, 108, 2/90, 16

See application file for complete search history.

(56) References Cited

U.S. PATENT DOCUMENTS

| | | | | | |
|---|---|---|---|---|---|
| 2,128,796 | A | | 9/1938 | Bohm-Myro | 2/158 |
| 2,274,335 | A | | 2/1942 | Kennedy | 2/158 |
| 2,315,889 | A | * | 4/1943 | Wells | 2/158 |
| 2,323,136 | A | * | 6/1943 | Johanson | 2/158 |
| 2,340,017 | A | | 1/1944 | Rasmussen | 2/270 |
| 2,603,790 | A | | 7/1952 | Boehm-Myro | 2/158 |
| 2,836,828 | A | * | 6/1958 | Henrikson | 2/158 |
| 3,214,771 | A | * | 11/1965 | Treiber | 2/270 |
| 3,299,441 | A | | 1/1967 | Slimovitz | 2/158 |
| 3,403,408 | A | | 10/1968 | Helfer | 2/158 |
| 4,195,405 | A | | 4/1980 | Monk | 2/158 |
| 4,359,784 | A | | 11/1982 | Harrington | 2/269 |
| 4,383,336 | A | | 5/1983 | Beckman et al. | 2/158 |
| 4,559,647 | A | * | 12/1985 | Smith et al. | 2/158 |
| 4,651,350 | A | | 3/1987 | Dawiedczyk | 2/158 |
| 4,698,850 | A | | 10/1987 | Patton, Sr. et al. | 2/159 |
| 4,756,027 | A | * | 7/1988 | Buenos et al. | 2/123 |
| 4,805,338 | A | | 2/1989 | Schublom | 43/25 |
| 4,933,992 | A | | 6/1990 | Kallman | 2/160 |
| 4,944,041 | A | | 7/1990 | Buenos et al. | 2/84 |
| 5,125,117 | A | * | 6/1992 | Buenos et al. | 2/239 |
| 5,172,427 | A | | 12/1992 | Van Bergen et al. | 2/158 |
| 5,388,270 | A | * | 2/1995 | Hewitt | 2/93 |
| 5,444,874 | A | * | 8/1995 | Samelian et al. | 2/159 |
| 5,504,944 | A | | 4/1996 | Bromer et al. | 2/269 |
| 5,517,693 | A | | 5/1996 | Noonan | 2/159 |
| 5,673,836 | A | | 10/1997 | Bush | 224/576 |

(Continued)

FOREIGN PATENT DOCUMENTS

EP 0245097 * 11/1987

*Primary Examiner*—Tejash Patel
(74) *Attorney, Agent, or Firm*—Allen H. Erickson

(57) ABSTRACT

A versatile upper body multi-mode garment is configured to provide a variety of modes of wear with respect to hand coverings and head covering. A coat, jacket, shirt or vest has an integral hood which covers the wearer's head. Within the hood is an integral face shield which may be swung behind the wearer's head or neck when not covering the face, enabling protection of various portions of the face. The hood may be tightened to expose a variable extent of the head or face. Versatile multi-mode mitten portions attached to the garment or mittens provided separately enhance a variety of modes of wear which are achieved without removing the mittens or any portion thereof. The wearing modes include full exposure of a hand, exposure of the thumb and the four fingers, exposure of the four finger tips, full hand coverage, and full hand coverage by an integral glove. The hand coverings may be provided as separate mittens.

12 Claims, 11 Drawing Sheets

U.S. PATENT DOCUMENTS

| | | | | |
|---|---|---|---|---|
| 5,678,248 | A | 10/1997 | Lengyel | 2/158 |
| 5,711,032 | A * | 1/1998 | Carpenter | 2/158 |
| 5,765,230 | A | 6/1998 | Sivret et al. | 2/202 |
| 5,774,894 | A | 7/1998 | Yates et al. | 2/158 |
| 5,794,265 | A * | 8/1998 | Reich | 2/125 |
| 5,953,758 | A * | 9/1999 | Foster | 2/268 |
| 6,076,189 | A * | 6/2000 | Christman et al. | 2/158 |
| 6,249,916 | B1 * | 6/2001 | Mellon et al. | 2/125 |
| 6,253,381 | B1 * | 7/2001 | Kelley | 2/125 |
| 6,272,690 | B1 | 8/2001 | Carey et al. | 2/206 |

* cited by examiner 10C
30A
28
138
32
40
148
142
12
24
26
150
154
156
70
46
48
158

VERSATILE GARMENT

BACKGROUND OF THE INVENTION

1. Field of the Invention

The present invention relates to upper body garments. More specifically, the invention relates to multifunctional garments which may be worn in a variety of different modes to accommodate a wide range of atmospheric conditions and activities of the wearer. The invention more particularly pertains to coats, jackets, vests or shirts, with appurtenances thereto particularly including headwear and handwear.

2. State of the Art

The need for warm upper body garments, e.g. coats and jackets, has always been important for humanity. In regions which experience cold temperatures, it has been found that heat transfer from a person's head and extremities, e.g. arms and legs (particularly the hands and feet) is most critical. This is because the ratio of surface area to mass is highest in these areas, and human activity is often predicated upon having at least a portion of the head and hands being exposed, i.e. uncovered at times. This is true of many outdoor winter activities which are becoming very popular, such as skiing, ski-touring, ice climbing, mountain climbing, rock climbing, ice sailing, skating, ice fishing, hunting, snowmobiling, snowshoeing, winter camping and the like.

In cold-weather use of an upper body garment such as a jacket or coat, heat transfer from a wearer's body typically occurs in several specific areas. First, there is general heat transfer through the body and arms of the garment. This heat loss may be controlled by varying the insulative value of the coat material, and/or as commonly practiced, by layering of shirts, sweaters, etc. under the outer garment. Secondly, there is heat loss by movement of air through the space between the lower extremity of the coat and the person's waist. This heat loss may be controlled by varying the tightness of the coat about the person's waist. Thirdly, there is heat loss from exposure of the wearer's head, which in many cases is the major source of heat loss from a wearer's upper body. Control of the head area which is exposed, and varying the insulative properties of the head covering, are two methods used to effect a desired head temperature. Fourthly, heat transfer from the hands and lower arms is also very important. Many cold weather activities require the uncovering of the fingers or the entire hand at times, or use of a fingered glove in place of a mitten.

In the field of upper body garments, headwear and handwear, the art is filled with a plethora of designs and configurations of hand coverings and head coverings which may be used with or be a part of a cold weather jacket. These prior art apparel were generally intended to providing a particular function. Some of the hand coverings provide for alternative use as mittens and fingered gloves.

U.S. Pat. No. 5,076,189 to Christman et al., a garment is shown with cuffs which are retractable over inner gloves to provide additional warmth, or alternatively, cooling, to the fingers.

U.S. Pat. Nos. 4,756,027 and 4,944,041 to Buenos et al. shows a similar arrangement, wherein an inner glove portion in the garment sleeve has finger chambers with ends which fold backward to expose the fingertips.

In U.S. Pat. No. 2,340,017 to Rasmussen, an outer garment or coat for a child is shown with attached mittens with integral slide fasteners which are configured to prevent a child from opening thereof without removing the garment.

U.S. Pat. No. 5,504,944 to Bromer et al. discloses a jacket sleeve with an opening through which a thumb may be placed to retain the sleeve over a portion of the hand, when no mittens or gloves are used.

In U.S. Pat. No. 2,274,335 to Kennedy, a mitten is shown with a full-width aperture in the palm, permitting a user's fingers to slide out of the mitten to handle keys, tickets and the like. A welt along the edge of the aperture serves to close the aperture and provide a supplemental grip for grasping a steering wheel.

U.S. Pat. No. 5,678,248 to Lengyel and U.S. Pat. No. 4,383,336 to Beckman et al. disclose mittens having a slitted end for extending one's fingertips out of the mitten. In order to maintain the fingers covered, the fingers must be folded within the mitten. In U.S. Pat. No. 5,172,427 to Van Bergen et al., the mitten is sufficiently large for maintaining the fingers in an unfolded state.

U.S. Pat. No. 3,403,408 to Helfer describes a hand covering having an inner glove covered by an outer mitten having a full-width slit through which the glove's fingers may be extended.

In U.S. Pat. No. 3,299,441 to Slimovitz, a hand covering similar to that of Helfer has a slitted mitten whereby the fingertips may be extended through the slit.

In U.S. Pat. No. 5,673,836 to Bush, a mitt is shown in which the distal end is closed by a VELCRO® member so that the finger ends may be exposed when desired.

A similar mitt is shown in U.S. Pat. No. 4,805,338 to Schublom. In this patent, the mitt has adjoining break-apart edges which may be peeled back to expose a user's hand.

In U.S. Pat. No. 4,933,992 to Kallman, an attachment for a glove is described which slides over the back surface of the glove and is held there by several straps. The attachment includes portions which slip over the fingers and thumb of the glove to provide added insulation, and includes space for storing keys, money, etc.

A variety of other openable mitts/gloves are found in the prior art. For example, mittens having a substantial terminal portion closable by a zipper are described in U.S. Pat. Nos. 2,128,796 and 2,603,790 to Bohm-Myro and U.S. Pat. No. 4,359,784 to Harrington.

U.S. Pat. No. 2,323,136 to Johanson, U.S. Pat. No. 2,836,828 to Henrikson, and U.S. Pat. No. 4,195,405 to Monk describe soft fabric mittens in which slots permit protrusion of a user's fingers or gloved fingers through the mitten fabric.

In U.S. Pat. No. 3,214,771 to Treiber, a mitten is contained in a zippered pocket in a coatsleeve. The mitten may be retracted and positioned over the cuff for wear.

U.S. Pat. No. 4,651,350 to Dawiedczyk shows a work glove which has open truncated finger portions and a thumb portion with an intermediate hole. A half mitten is attached to the back of the glove and may be pivoted forward to cover the exposed fingers.

U.S. Pat. No. 5,774,894 to Yates et al. shows a thermal mitten for golfers in which a finger enclosure contains an in-wall heating device. The finger enclosure may be folded back and attached to the lower portion of the mitten by a VELCRO strip.

In U.S. Pat. No. 5,517,693, to Noonan, a hand covering is depicted which has an L-shaped palmar slot with a flap to seal the slot. The wearer's hand may be extended through the slot for exposure.

U.S. Pat. No. 4,698,850 to Patton, Sr. et al. describes a therapeutic exercise glove with a finger enclosure adjustably attached by straps to a palmar region to position the fingers in a desired bent-forward bent-backward position for therapy.

None of the above references provides a unitary hand covering which may function as an open sleeve, thumbed open sleeve, fingerless glove, full glove, or full mitten.

In U.S. Pat. No. 5,765,230 to Sivret et al., a head apparel is shown as a tubular hood configured so that a bottom portion may be rolled up inside the upper portion to become a face covering. Alternatively, the user's face may be projected through a face opening and the apparel placed on the shoulders.

In U.S. Pat. No. 6,272,690 to Carey et al., a head covering includes a neoprene mask member with holes for breathing. Goggles may be fitted to complete substantial covering of the user's head, face and neck.

None of the references show a garment hood in which a face shield may be retracted without changing the overall dimensions of the hood, or that may be alternatively positioned over the face or over the back of the head, when placing the head covering over the head.

BRIEF SUMMARY OF THE INVENTION

The present invention is, in one embodiment, an upper body garment such as a jacket, coat, shirt or vest configured for cold-weather use where large temperature variations may be encountered. The garment integrally includes or is configured for use with particular headwear and/or handwear, each of which is uniquely designed to be used in a variety of ways to achieve a desired combination of warmth, comfort and dexterity. The torso portion, arms and head covering of the garment may be formed of materials which have the appropriate strength, insulation value, water resistance, stretchability and appearance. The hand covering portion may be formed of a pliable and/or non-pliable material, preferably a stretchable fabric such as a fleece, a hard-surfaced fleece, in combination with a "shell" type material such as GORTEX®. A variety of other fabrics may also be used, at least a portion of which must have high 2-way or 4-way stretch properties. The head covering and hand coverings of the invention may be combined in various configurations in combination with various garment types, i.e. coat, jacket, shirt, vest, vest with attachable/detachable arms, etc.

The head covering of the garment is a hood which is integrally formed with the torso portion. When fully deployed, the hood covers the wearers head surrounding the face. The hood edge at the face opening may include a channel encircling the wearer's face. A draw-string with terminal cinch devices may be carried in the channel for tightening the hood fabric about the face. In addition, in one embodiment, the hood includes an abbreviated brim for shading the wearer's eyes.

A particular feature of the hood is a soft porous face shield which is attached at each end to the inside of the hood. The face shield may be alternatively worn over the wearer's lower face, adjustable to cover and insulate either (a) the nose, mouth and neck, (b) the mouth and neck, or (c) the wearer's neck. When not used to cover the face, nose, mouth and/or neck, the face shield may be positioned behind the wearer's head or neck. Whether the hood is worn to cover the head, or pulled downward to form a "collar" about the neck (under the chin), the face shield may be usefully used to cover a portion of the face or neck. The face shield may be formed as a permanent part of the hood, or may be configured to be removably attached, as for example with Velcro™ pads, zippers, and the like. The face shield may be formed with a screen panel through which the wearer may breathe, minimizing condensation on the face shield.

The hand coverings comprise mittens which are formed to be multi-modal such that they may be worn to achieve various combinations and degrees of exposure for each of the hand, the thumb and the four fingers. The hand coverings may be terminal portions of the garment sleeves, or may be separate mittens which may be worn together with a jacket or shire, or may be worn independently of any particular body garment.

In one embodiment, the hand covering comprises a fabric tube with a full or substantially full end opening. The end opening is closeable by a 2-way pocket which may be flipped between the mitten's backside (to form a fully closed mitten) and the mitten's palmside, where it covers a thumb enclosure but opens the end opening for full or partial hand exposure. A thumb enclosure may be used whereby only the wearer's fingertips are exposed. A second feature is a thumbhole proximate the end opening whereby the wrist and lower hand may be maintained in a covered condition while the fingertips and thumb are exposed.

A second embodiment is similarly formed, but in addition has glove finger enclosures open to the tube and stored under the 2-way pocket. With the 2-way pocket flipped to the mitten's backside, the glove finger enclosures may be configured as one enclosure for each of the four fingers, or enclosures for 2 and/or 3 fingers of the wearer.

Another embodiment of the hand covering comprises a mitten having a tubular body with a distal open end which folds back over the back of a wearer's hand. The folded portion is held in a folded-back position by one or more stretch cords attached between the distal open end and the backside of the hand covering. When in a closed position (distal end folded back), a wearer can achieve full or partial hand exposure by pushing the hand axially outward through the tubular body to unfold the distal end. The stretch cords then retract the open end backwardly over the wearer's fingers, forming a wrinkled cuff end. When the mitten is used in the open end position, a thumb enclosure may be folded rearwardly beneath a thumb pocket on the exterior of the tubular body. The mitten may include a thumb hole near the open end to facilitate a position having less than full hand exposure, for example, exposure of the thumb and partial finger exposure. Portions of the mitten which cover the fingers are preferably formed at least in part of a stretchable fabric.

In one version of the garment, a jacket with a hood and face shield has arms which are attached by zippers or other attachment devices such as Velcro® strips and the like. The cuffs of the arms may include thumb holes, Velcro® tightening strips, or hand coverings of any of the embodiments described herein.

The garment including body, hood, face shield, arm portions and hand coverings may be formed of a variety of materials, such as artificial fleece, hard-faced fleece, shell material such as known as Gortex© and other materials, particularly those with a high degree of elasticity or stretchability.

The various combinations of features provide enhanced versatility to the garment, enable a wearer to adapt the hand coverings and head covering to a wide variety of atmospheric conditions (temperature, wind, precipitation, etc.) and degree of physical exertion, without requiring removal or attachment of a separate headwear unit and/or separate handwear units. The versatile garment of the invention is particularly useful when participating in strenuous or dangerous sports, permitting adjustment of hand/finger dexterity and thermal coverage of hands/face during the participation.

Loss of garment items under high stress conditions is eliminated or reduced, and wearer comfort is maintained at all times.

BRIEF DESCRIPTION OF THE SEVERAL VIEWS OF THE DRAWINGS

The nature of the present invention as well as other embodiments thereof may be more clearly understood by reference to the following detailed description of the invention, to the appended claims, and to the several drawings herein, wherein;

FIGS. 5, 6, 7 and 8 are general depictions of a mitten end of a garment of the invention showing various modes of wear, wherein:

FIG. 5 shows a full hand exposure mode of mitten wear;

FIG. 6 shows a thumb and partial finger exposure mode of mitten wear;

FIG. 7 shows a finger tip exposure with covered thumb mode of mitten wear;

FIG. 8 shows a full covering mode of mitten wear;

DETAILED DESCRIPTION OF THE INVENTION

Figure 1:
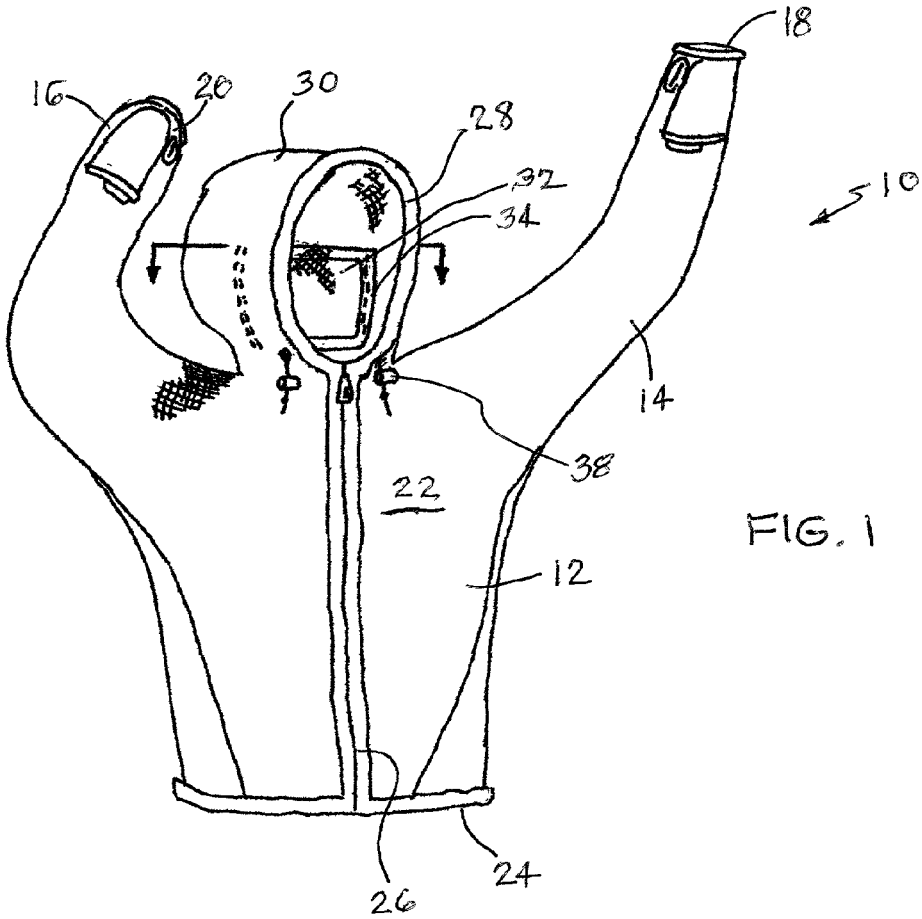
FIG. 1 is a general frontal view of a first exemplary embodiment of a garment in a closed position with versatile mittens and head covering in accordance with the invention.

In use and operation, and referring to FIG. 1, a first exemplary embodiment of garment 10 of the invention is depicted as a coat or jacket. As shown, the garment 10 includes a torso portion 12 with integral arm portions 14 and an integral head covering 30 comprising a hood. Each arm portion 14 comprises a tube extending from the torso portion 12 to a lower sleeve portion 16, shown with a terminal hand covering comprising an integral mitten 20 of the invention. The mitten 20 is shown with a terminal opening 18 through which a user's hand may be extended.

As shown in FIG. 1, the exemplary garment 10 has a front portion 22 with a zipper 26 which extends from the lower garment edge 24 to opening 28 in the head covering (hood) 30. The head covering 30 may be fitted with a circumferential cinch cord or drawstring 38 for tightening about the wearer's head. A face shield 32 comprises an elongate insulative member with each end 34 attached (fixedly or temporarily) to the inside of the head covering 30. It will be described in more detail, infra.

Figure 2:
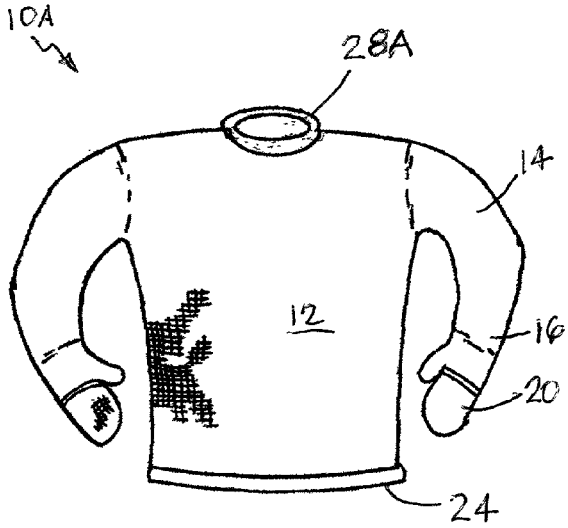
FIG. 2 is a general frontal view of a second exemplary embodiment of a garment with versatile mittens in accordance with the present invention.

FIG. 2 depicts a second exemplary garment 10A such as a shirt, sweater or sweatshirt. The garment 10A is shown with a torso portion 12 with lower edge 24, and a head opening 28A. The garment 10A is shown without a head covering 30 and torso zipper 26, but with versatile hand coverings 20 at lower sleeve portions 16 of arms 14. The versatile hand coverings 20 comprise elements of the invention which provide for multi-modal wear.

Figure 3:
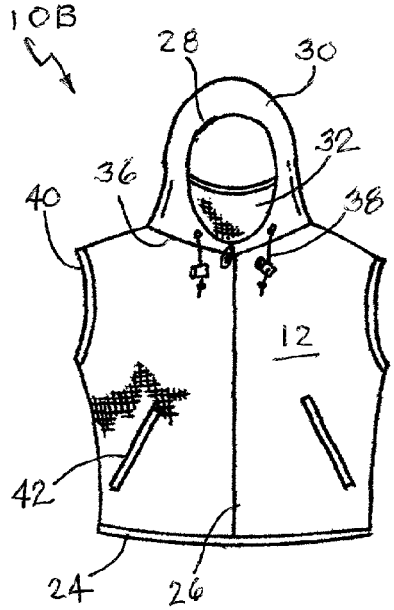
FIG. 3 is a general frontal view of a third exemplary embodiment of a garment with a head covering in accordance with the invention.

In FIG. 3, another embodiment of the invention is shown as a vest type garment 10B comprising a torso portion 12 with lower edge 24. An integral head covering 30 is joined to the torso portion 12 along seams 36, and is shown as a hood with a manipulable face shield 32. The head covering 30 has an opening 28, about which a cinch cord 38 is used to tighten the covering over a wearer's head. The garment 10B is also shown with exemplary front zipper 26, arm openings 40, and pockets 42.

Figure 4:
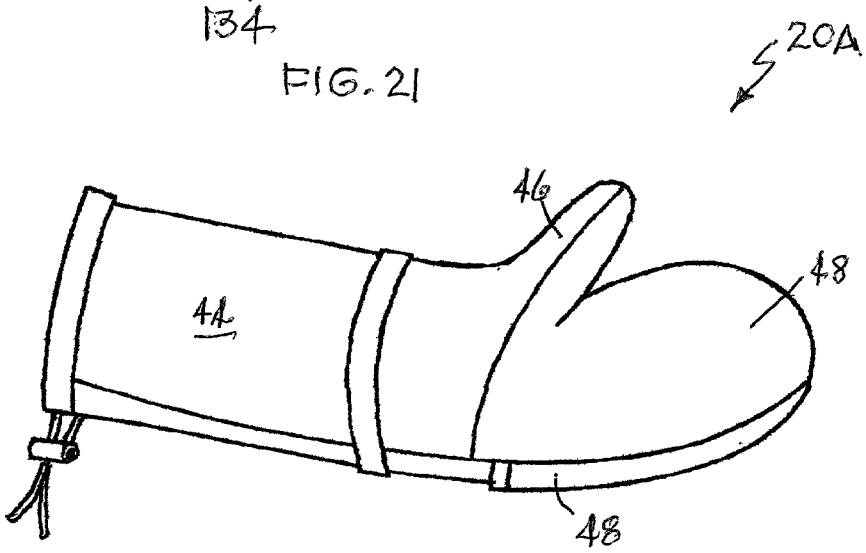
FIG. 4 is a general frontal view of a mitten hand covering of the invention.

The various embodiments of hand covering 20 of the invention are described, infra. Each may be formed as an extension of a lower sleeve portion 16, or as an individual mitten unit which may be worn independently of any particular body garment (see the example in FIG. 4 which is configured in a full enclosure mode). A first embodiment 20A of hand covering 20 is shown in different modes of wear in FIGS. 4, 5, 6, 7 and 8. The hand covering 20A includes a tubular portion 44 into which a person's hand 50 may pass.

The tubular portion 44 has an opening 18 at its distal end (terminal end) 66, and an integral thumb enclosure 46. A 2-way pocket 48 is attached, e.g. sewn on three edges 60 to peripheral portions of the frontside 62 of the tubular portion 44 of hand covering 20A. The fourth edge of the pocket 48 is not attached to the tubular portion 44 but comprises a pocket opening 58 into which the thumb enclosure 46 may be inserted when not being used to cover the person's thumb. The hand covering 20A may include a thumb hole 70 near the distal end 66, through which a person's thumb may be inserted when it is desired to expose a major portion of the fingers 54 while keeping the palm 51 and hand backside 57 covered.

Figure 5:
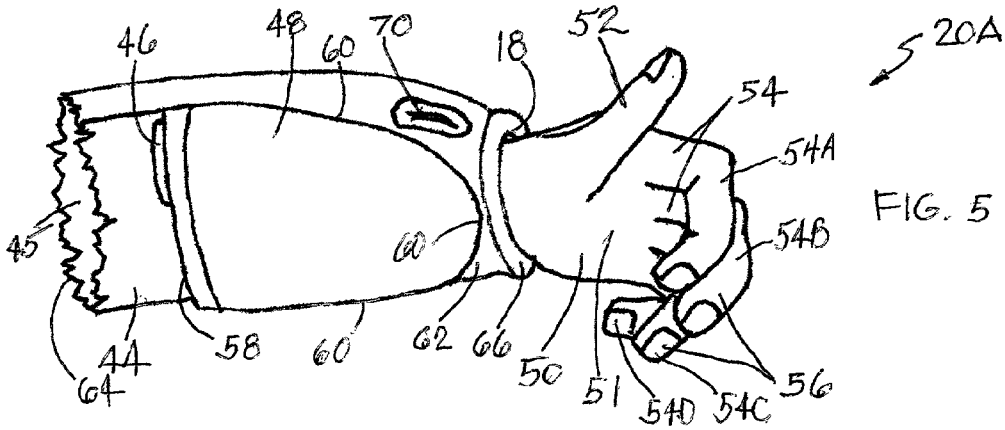

Turning now to the full-hand-exposure wearing mode of FIG. 5, it is evident that the thumb enclosure 46 is folded under the 2-way pocket 48 covering a portion of the front side 62 of the hand covering 20A. The thumb enclosure 46 is thus retained in a non-interfering position. The full hand 50 is shown projecting from the terminal opening 18, enabling full hand manipulation. FIG. 5 also shows the forefinger (first finger) 54A, second finger 54B, third finger 54C and little finger 54D as part of the exposed hand 50.

Figure 6:
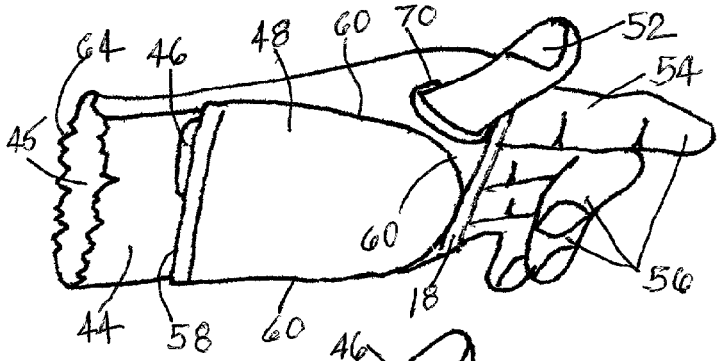

In FIG. 6, a wearer's hand 50 is withdrawn partially into the tubular portion 44 and the thumb 52 inserted through the thumb hole 70. The thumb hole 70 limits the extent to which the hand 50 may be uncovered. In this wearing mode, the fingers 54 are largely uncovered while non-finger portions of the hand are largely covered.

Figure 7:
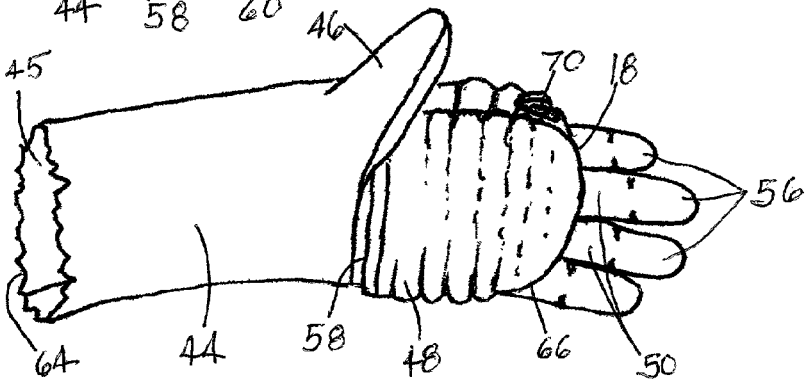

As shown in FIG. 7, the thumb enclosure 46 may be retracted from the 2-way pocket 48, and the wearer's thumb 52 inserted into the thumb enclosure 46 while further withdrawing the hand 50 into the tubular portion 44. The distal end 66 of the hand covering 20A may then be drawn back to expose the fingers 50 (particularly the finger tips 56) to any desired extent. In this "fingerless glove" wearing mode, the thumb 52 is enclosed and the fingertips 56 exposed. Thus, fingertip dexterity is assured without exposing the thumb 52.

Figure 8:
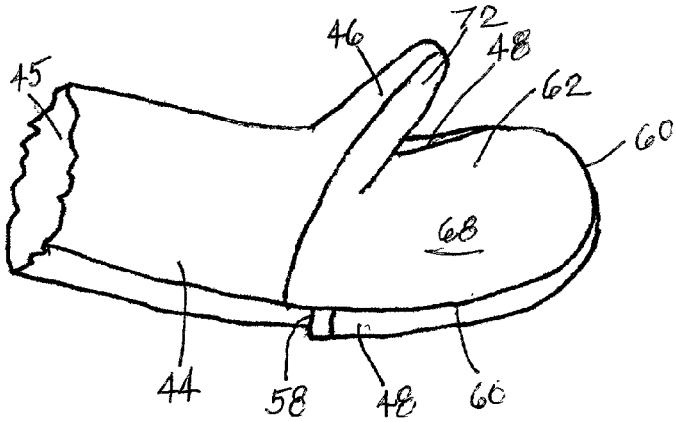

As shown in FIG. 8, the 2-way pocket may be pulled over the distal end 66 of the tubular portion 44, including opening 18, to form a full hand enclosure mode. A wearer's hand is fully covered in this mode. The palm area 68 of the front side 62, together with the thumb underside 72, may be formed of a material which is conducive to the hand movements required by the particular activities of the wearer. For example, where the hands must form a tight grip on a rope, the palm area 68 and thumb underside 72 may be formed of a material with a non-slippery surface.

The hand coverings 20 of the invention may generally be formed of a pliable and/or non-pliable material, or combinations thereof, preferably a stretchable fabric such as a fleece, a hard-surfaced fleece, or a "shell" type material such as GORTEX®. A variety of other fabrics may also be used to achieve the desired properties of stretchability, non-slipperiness, strength, wear, surface hardness and insulation value.

Figure 9:
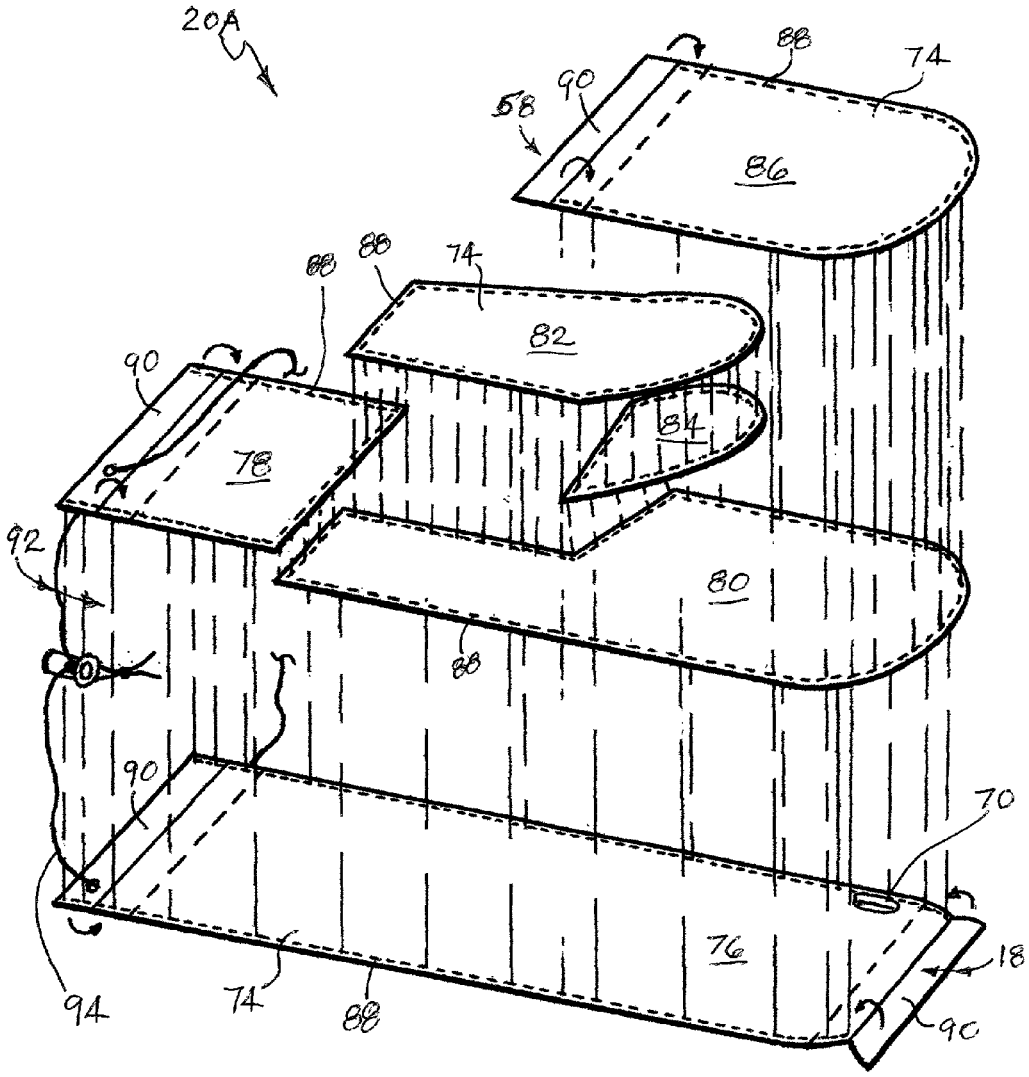
FIG. 9 is an exploded perspective view of the elements of a first mitten embodiment of the invention including sew lines.

A hand covering 20A may be formed of a plurality of fabric panels such as depicted in the exploded view of FIG. 9, shown for a left hand mitten. As shown, a fabric or fabrics 74 may be cut to form a back panel 76, upper wrist panel 78, upper hand panel 80, upper thumb panel 82, underside thumb panel 84, and pocket panel 86. The panels are joined, as by sewing, along sew lines 88. Panels 76, 78 and 86 are each shown with one or more folding ends 90 which are to be folded back and sewn to the panel, creating finished edges about the terminal opening 18, wrist opening 92, and pocket opening 58. This embodiment of the hand covering 20A is shown as a separate mitten, i.e. not part of a garment arm, and includes a cinch cord 94 contained within folded ends 90 of the wrist opening, for tightening about a wearer's wrist or lower arm. Also shown in FIG. 9 is a thumb hole 70 as previously described.

The hand covering 20A may be formed from panels with different shapes and size. For example, panels 78 and 80 may comprise a single panel. Alternatively, panels 76, 78 and 80 may comprise a single panel, enabling formation of the tubular portion 44 by sewing their longitudinal edges together along one seam. Alternatively, panels 80 and 84 may be combined as a single panel. Various other modifications in construction are possible.

Figure 10:
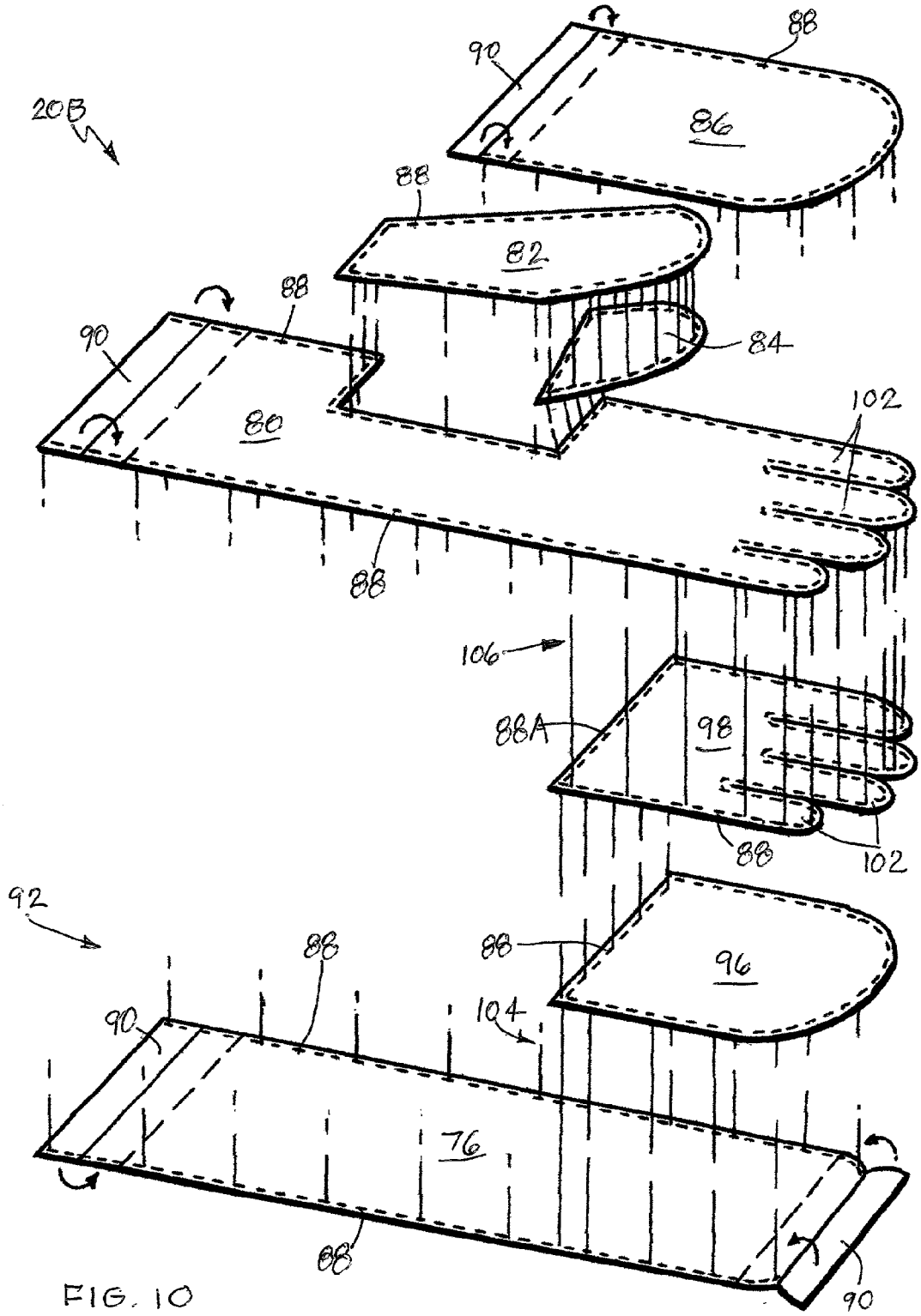
FIG. 10 is an exploded perspective view of the elements of a second mitten embodiment of the invention including sew lines.
Figure 11:
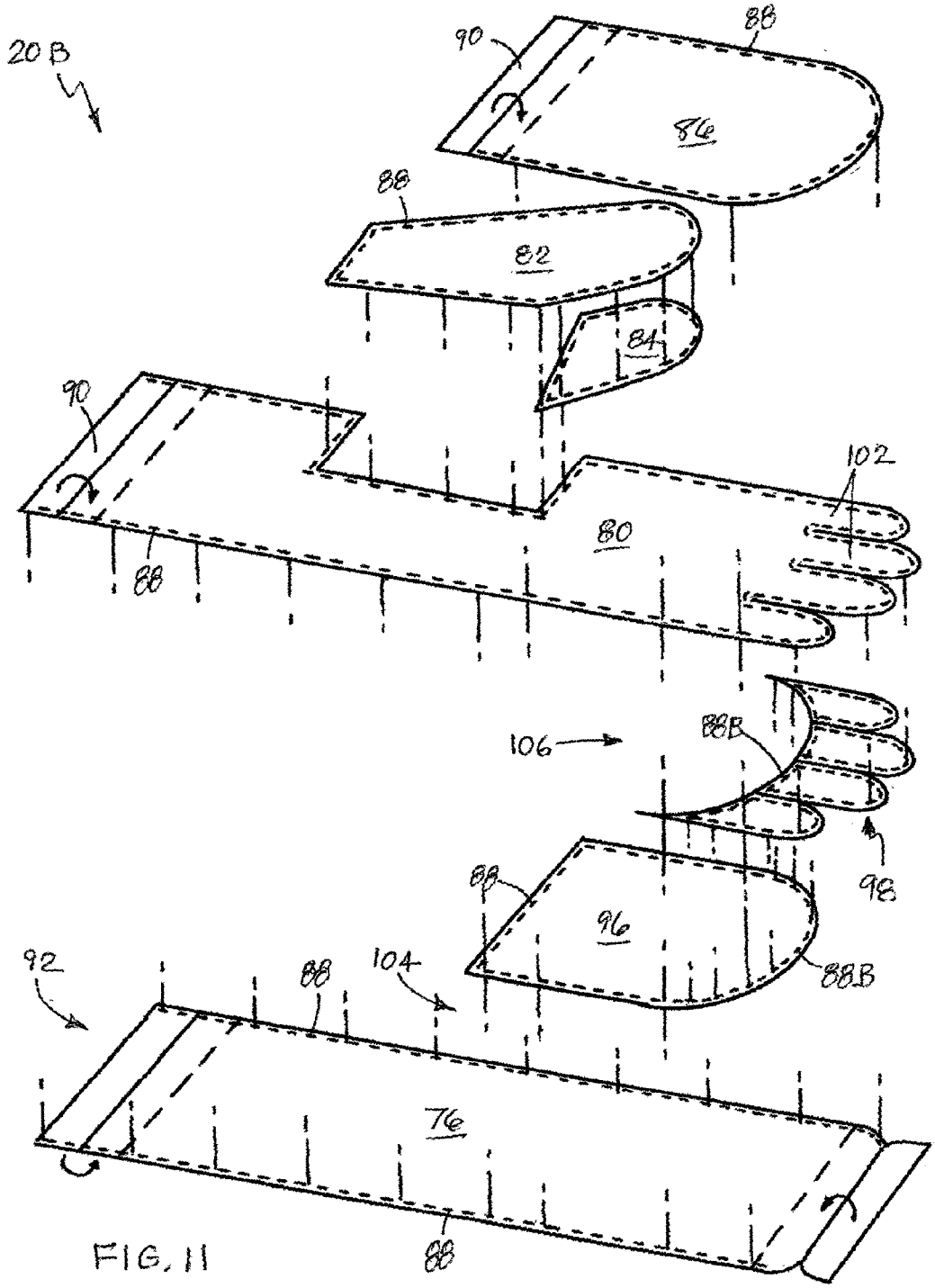
FIG. 11 is an exploded perspective view of the elements of a second mitten embodiment of the invention including sew lines and a differing construction.
Figure 12:
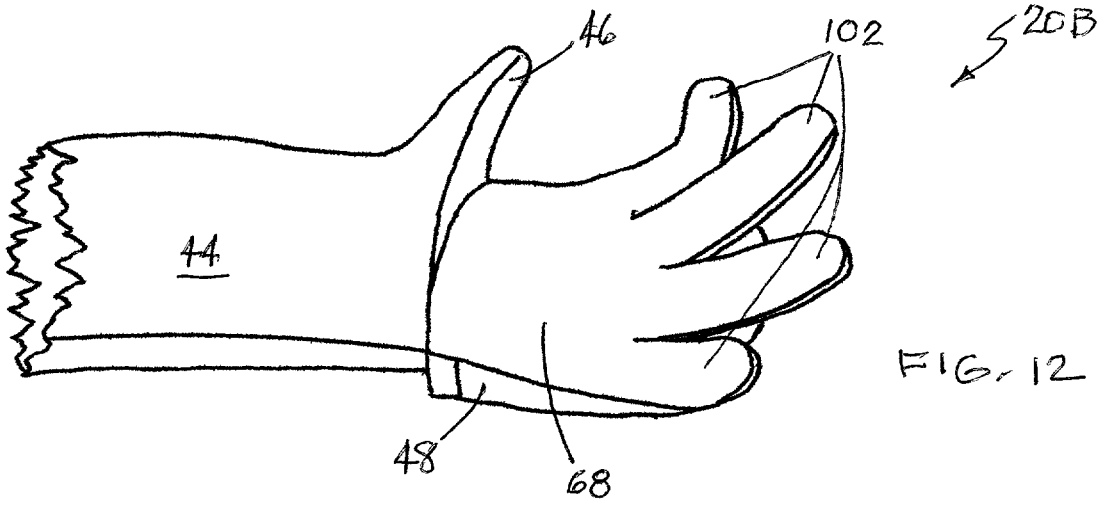
FIG. 12 is a general depiction of a second embodiment of a mitten end of a garment of the invention showing a further glove enclosure mode of mitten wear.

Another general hand covering embodiment 20B is illustrated in FIGS. 10, 11 and 12. As shown in the exploded view of FIG. 10, the hand covering 20B is formed of back panel 76, intermediate panel 96, front finger panel 98, upper hand panel 80 with finger portions 102, upper thumb panel 82, underside thumb panel 84, and pocket panel 86. When joined by sewing along sew lines 88, a hand covering is formed which provides for wearing modes of FIGS. 5–8, as well as a glove finger mode illustrated in FIGS. 12, 13 and 14. The finger glove 100 formed from panels 98 and 80 has its panel 98 sewn to panel 96 only along a generally straight upper sew line 88A, enabling freedom of action independently of panel 96. The hand covering 20B includes a wrist opening 92, full-exposure opening 104, and glove opening 106. In this embodiment 20B, a finger glove 100 formed from panels 98 and 80 is folded in 2-way pocket 48, out of view. The pocket 48 may be folded back over the mitten backside 64 to expose the finger glove 100.

In one alternative form of construction, hand covering 20B may be formed by varying panels 96 and 98, as depicted in FIG. 11. The two panels 96, 98 are joined end to end at sew lines 88B to form finger portions 102 which project outwardly beyond the terminal opening 18. In this variation, panel 96 becomes an inner portion of the finger glove 100.

In FIG. 12, hand covering 20B is shown in a finger glove mode in which the four finger portions 102 and thumb enclosure 46 are opened for use by a wearer. The 2-way pocket 48 is folded back over the hand opening 18, not visible, whereby none of a wearer's hand is exposed.

Figure 13:
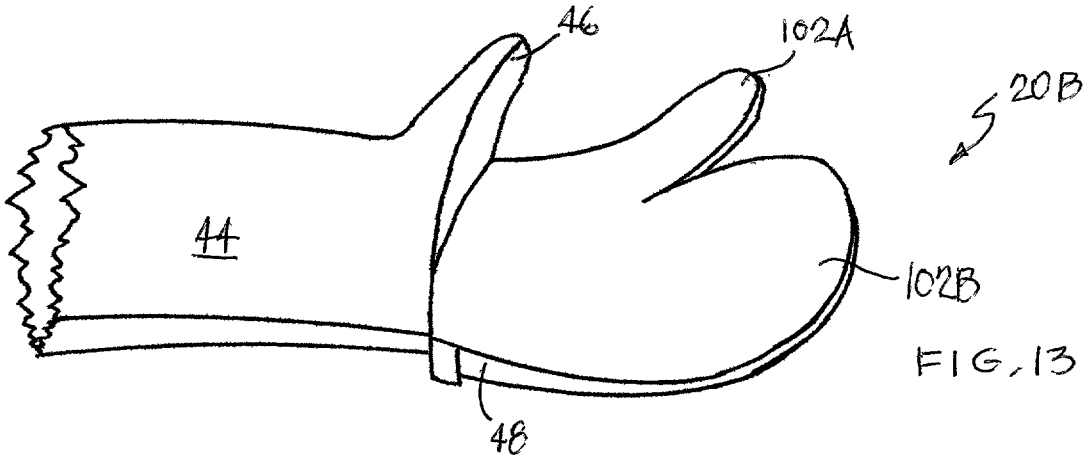
FIG. 13 is a general depiction of a variation of a second embodiment of a mitten end of a garment of the invention showing a further glove enclosure mode of mitten wear.

A variation of hand covering 20B is shown in FIG. 13 and includes a thumb enclosure 46 and two finger portions 102A and 102B. Finger portion 102A encloses the forefinger (index finger or "trigger finger") 54A of a wearer's hand, and finger portion 102B encloses the remaining three fingers (second finger 54B, third finger 54C and little finger 54D). In this embodiment, a separate finger portion 102A is provided for a trigger finger 54A, and is useful for hunting and military use, for example.

Figure 14:
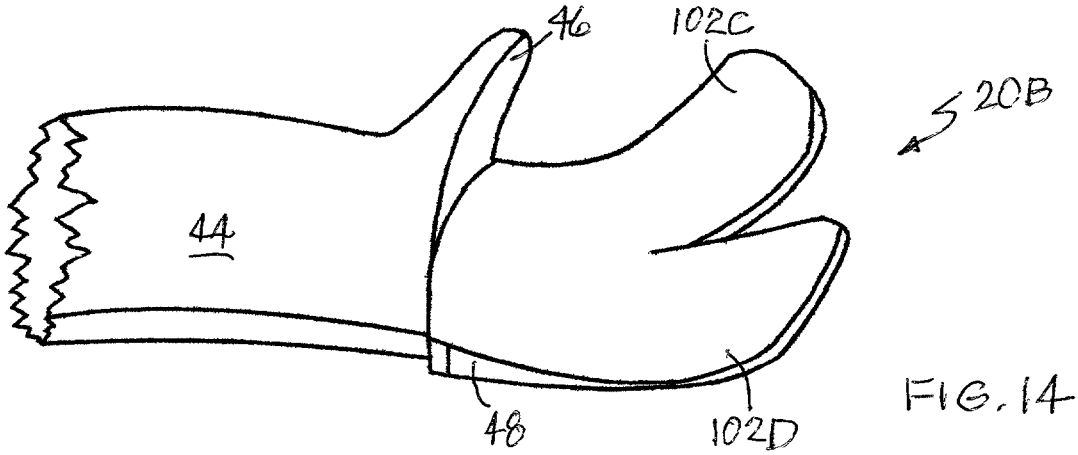
FIG. 14 is a general depiction of another variation of a second embodiment of a mitten end of a garment of the invention showing a further glove enclosure mode of mitten wear.

FIG. 14 shows a further variation, including a finger portion 102C for enclosing the index finger 54A and second finger 54B of a wearer, and a finger portion 102D for enclosing the remaining two fingers 54C and 54D. This embodiment, called herein a "lobster" version, is particularly useful for grasping a brake lever or clutch lever (not shown) when riding a bicycle or motorcycle. Any of the several variations of hand covering 20B may be fabricated using modified patterns of FIGS. 10 and 11, as well as similar patterns providing an equivalent mitten.

Figure 15:
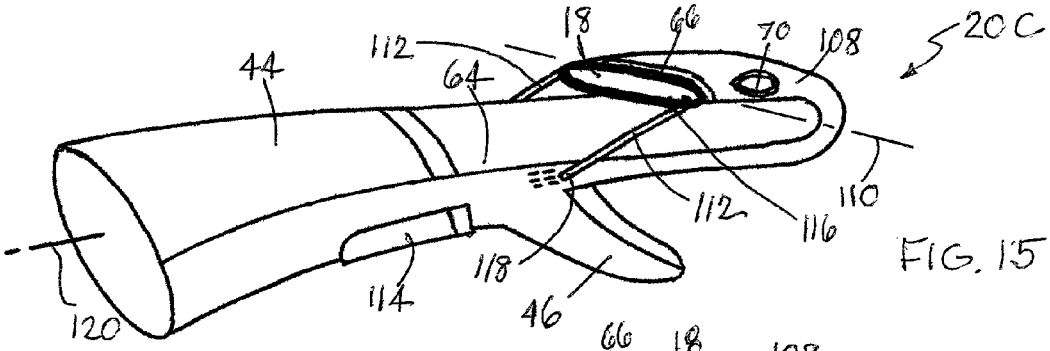
FIGS. 15, 16, 17 and 18 are general side depictions of an additional embodiment of a mitten end of a garment of the invention, illustrating steps in converting the mitten end from a fully closed position to a fully open position.

Another embodiment of a versatile hand covering 20C, as well as a method of changing wearing modes, is illustrated in FIGS. 15, 16, 17, and 18. As shown in FIG. 15, the hand covering 20C is in a no-exposure mode whereby an inserted hand is fully enclosed or covered. The hand covering 20C is formed of a tubular portion 44 with a terminal or distal opening 18. A thumb hole 70 is also shown near the distal end 66. In the fully closed mode shown in FIG. 15, an end portion 108 including terminal opening 18 is folded back over the mitten back 64 about cross axis 110 and held there by one or more tensile stretch cords 112. Each stretch cord 112 has one end 116 attached to the distal end 66 of the tubular portion 44, and the opposing end 118 attached to the tubular portion 44. A thumb enclosure 46 is formed to be an integral part of the tubular portion 44, and may be folded into a thumb pocket 114 which is proximate thereto. The hand covering 20C may be configured to be a separate mitten, or may be an integral part of a garment arm.

Figure 16:
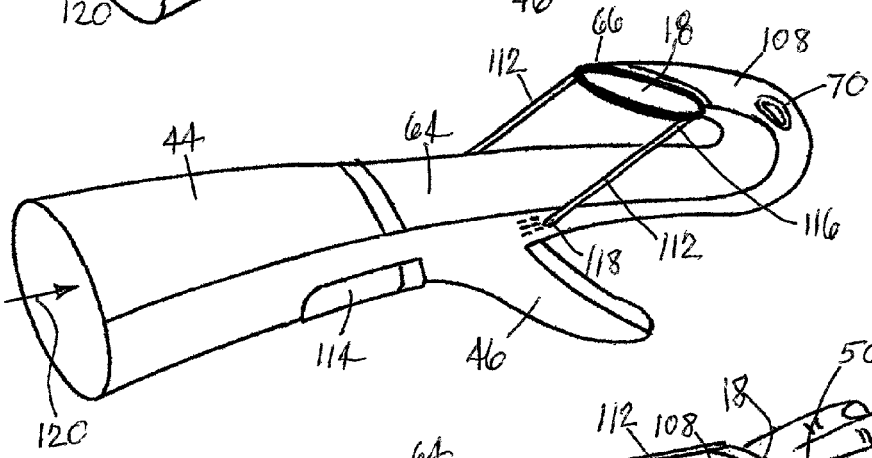

When a user wishes to expose a hand 50 or fingers 54, the arm and hand are pushed toward the terminal (distal) end 66 along axis 120, as depicted in FIG. 16. The end portion 108 is forced by the wearer's fingers 54 to straighten, elongating the stretch cords 112.

Figure 17:
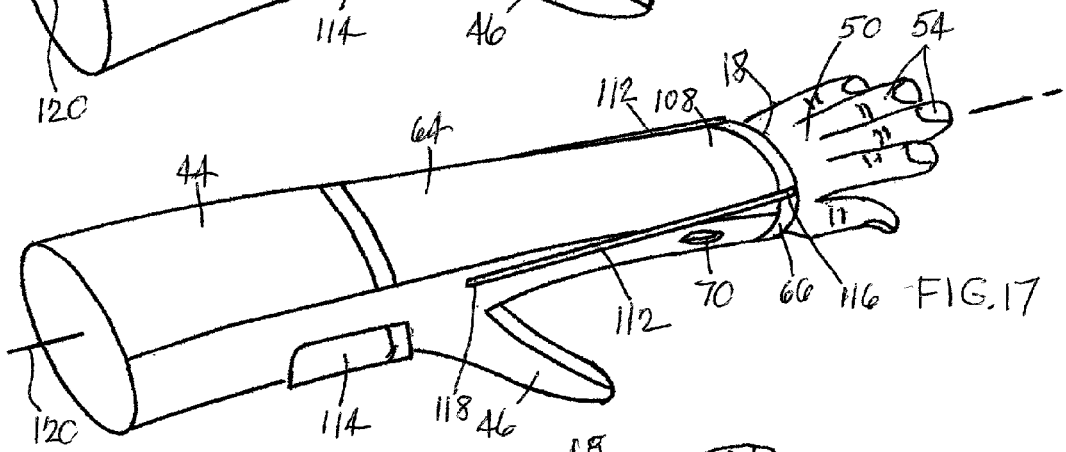
Figure 18:
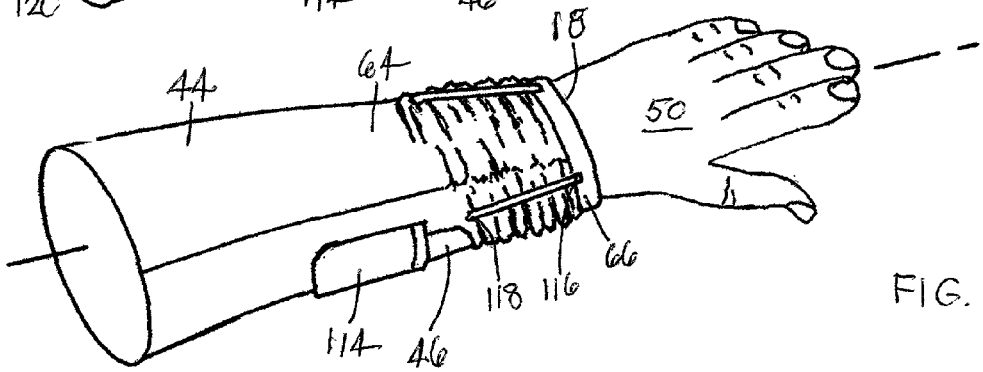

When the tubular portion 44 is fully extended by motion of a hand 50, the hand or fingers 54 may be passed through the terminal opening 18, as shown in FIG. 17. At this stage, the stretch cords 112 are fully extended. As depicted in FIG. 18, the tensile force of the stretch cords 112 then retract the end portion 108 toward a position of lower tension, fully exposing the wearer's hand 50. The thumb enclosure 46 may be folded back and inserted into thumb pocket 114 to maintain it in a non-intrusive position.

To return the hand covering 20C to a fully closed position, the steps are reversed. The end portion 108 is pushed outwardly over the hand 50 and the hand then withdrawn while the stretch cords 112 pull the end portion backward in parallel to the rest of the tubular portion 44.

Figure 19:
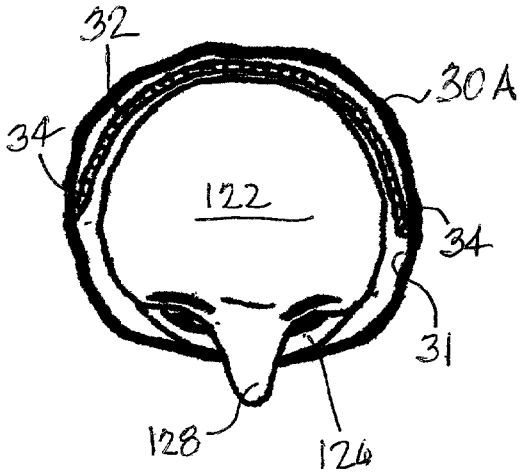
FIG. 19 is a cross-sectional view through a head covering of the invention, as taken along line 19—19 of G. 1.
Figure 20:
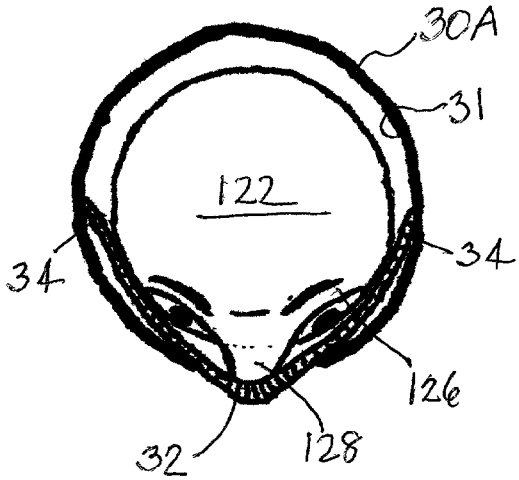
FIG. 20 is a cross-sectional view through a head covering of the invention, as taken along line 19—19 of FIG. 1.

Turning now to the head covering 30 of the invention, the sectional views of FIGS. 19 and 20 show the head covering as a hood 30A in which an insulative face shield 32 having ends 34 attached in generally vertical directions to the hood interior 31 on each side of the wearer's head 122. In FIG. 19, the face shield 32 is positioned behind the wearer's head 122 to leave the wearer's nose 128 and face 128 exposed.

Figure 21:
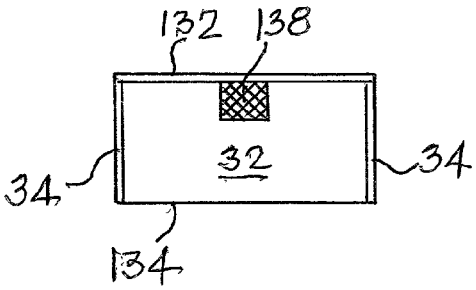
FIG. 21 is a plan view of a face shield of a garment of the invention.

In FIG. 20, the face shield 32 is positioned to cover significant portions of the wearer's face 128, including a portion of the nose 128. As depicted in FIG. 21, the face shield 32 is typically formed of a roughly rectangular panel of pliable material such as an insulative fabric, and has an upper edge 132, lower edge 134, and ends 34. A portion 138 of the shield 32 may be formed of a porous screening or similar material, and is located in the vicinity of the nose and/or mouth to permit heavy breathing by the wearer without saturating the shield with moisture. The ends 34 may be sewn to the inside of hood 30A or joined by other methods, for example by the use of Velcro® strips. In the latter case, the face shield 32 may be easily removed for cleaning or replacement.

Figure 22:
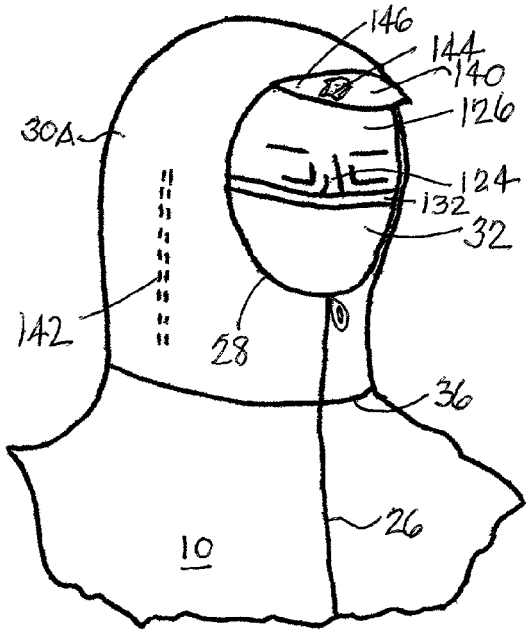
FIG. 22 is a generally frontal view of an exemplary head covering of a garment of the invention in a first mode of wear.

Various modes of wearing the head covering 30A are illustrated in FIGS. 22, 23, 24, 25, and 26, to achieve varying degrees of warmth. As shown in FIG. 22, garment 10 includes a hood 30A joined to the garment along seam 36, and has an opening 28 for face exposure. A face shield 32 is shown as overlying a lower portion of face 126 from the nose 124 downward. Sew lines 142 by which the shield ends 34 are attached to the hood 30A are shown. In addition, an abbreviated brim or bill 140 is shown as joined to an upper edge of opening 28, for shielding a wearer from sunlight or precipitation. The brim 140 may be formed of an interior shape-retaining member 144 with an outer water-resistant material 146. The brim 140 is configured to extend outward from the opening 28 a maximum of about 0.75 inch to about 2 inches. A zipper 26 or other opening device enables opening of the garment 10, including the front portion of the hood 30A.

Figure 23:
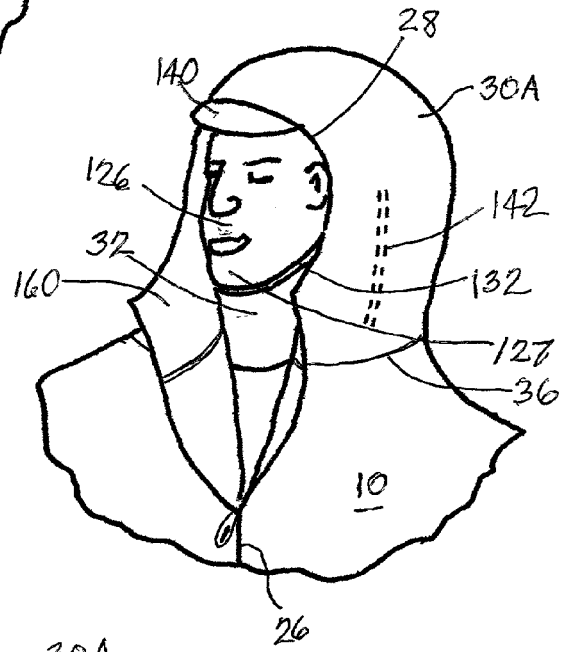
FIG. 23 is a generally frontal view of an exemplary head covering of a garment of the invention in a second mode of wear.
Figure 24:
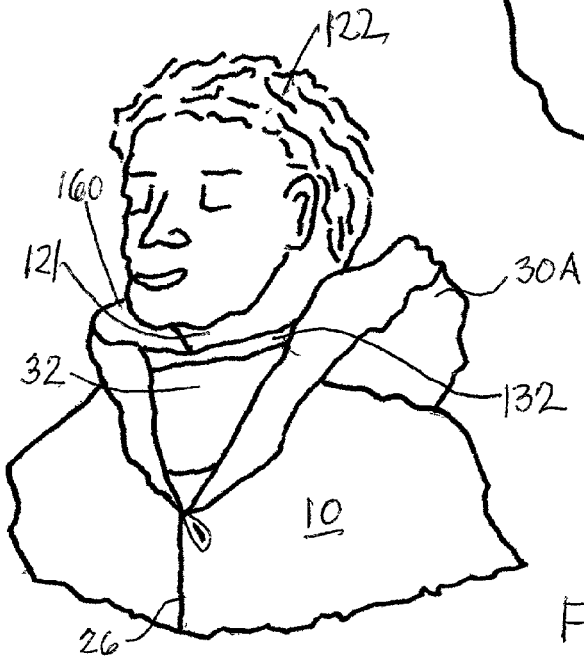
FIG. 24 is a generally frontal view of an exemplary head covering of a garment of the invention in a third mode of wear.

As shown in FIG. 23, a wearer's face 126 may be exposed by pulling the face shield 32 downward to below the chin 127, in which case the face shield covers the frontal portion of the neck 121. Zipper 26 may be partially opened for further air circulation, as shown FIG. 24 shows a wearer's head 122 from which the hood 30A has been drawn downwardly. Even in this position, and despite opening of an upper portion of garment 10, the face shield 32 will retain its position to insulate the front of the wearer's neck 121.

Figure 25:
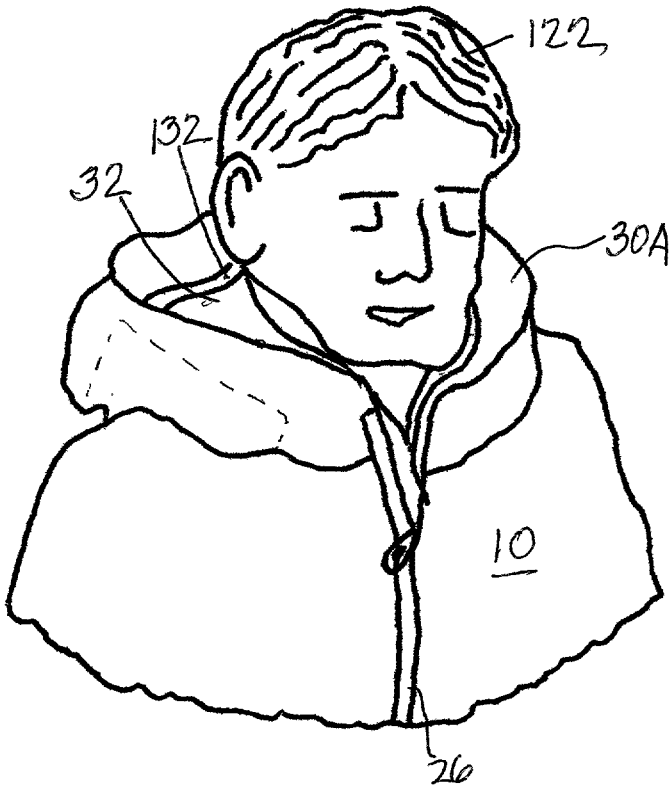
FIG. 25 is a generally frontal view of an exemplary head covering of a garment of the invention in a fourth mode of wear.

FIG. 25 illustrates a wearing mode wherein the wearer's head 122 is placed in front of the face shield 32. In this configuration the wearer's head 122, face 126 and frontal portions of the neck 121 are fully exposed.

Figure 26:
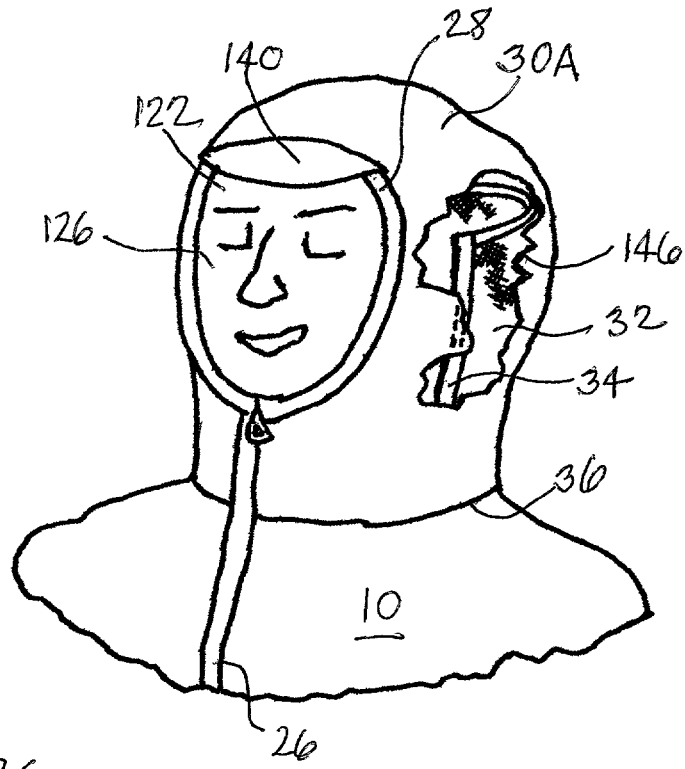
FIG. 26 is a generally frontal view of an exemplary head covering of a garment of the invention in a fifth mode of wear.

FIG. 26 depicts a wearing mode in which the garment 10 is closed, and the face shield 32, visible in cutaway 146, is positioned behind the head 122, leaving the wearer's face 126 uncovered.

Figures 27, 28, 29, 30:
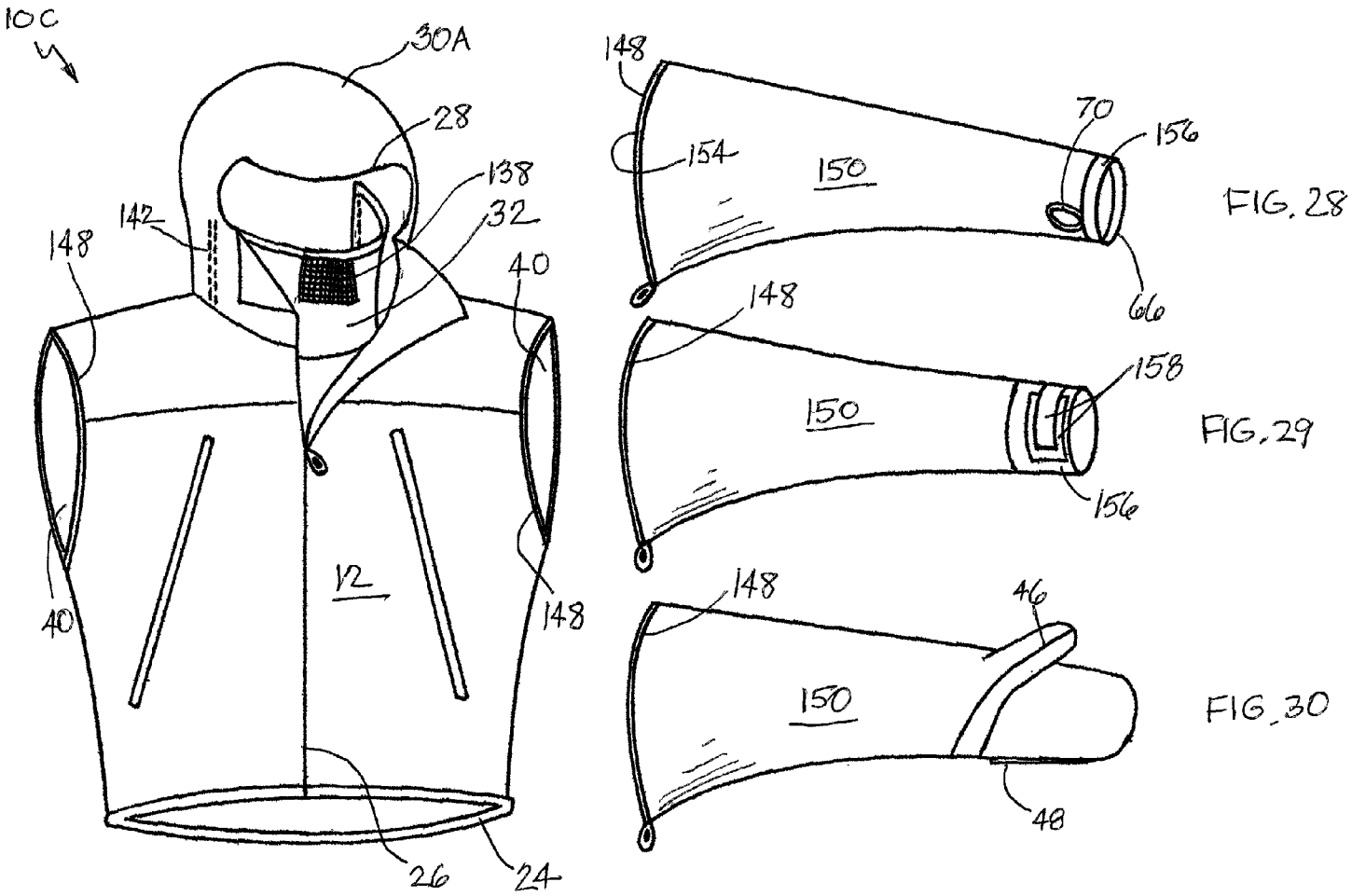
FIG. 27 is a frontal view of an additional garment of the invention configured to have attachable/removable arms.
FIG. 28 is a side view of an attachable/removable arm of the invention.
FIG. 29 is a side view of another embodiment of an attachable/removable arm of the invention.
FIG. 30 is a side view of a further embodiment of an attachable/removable arm of the invention.

A further embodiment of the garment 10 of the invention comprises a vest/coat or vest/shirt combination 10C exemplified in FIG. 27. A torso portion 12 is configured for attachment of removable arms 150 by zippers 148 in shoulder regions 152, converting the vest to a coat. Various removable arms 150 may be configured for particular uses and/or climatic conditions. In FIG. 27, garment 10C is shown in a vest configuration (without arms 150) and includes a head covering 30A with a face opening 28 and a face shield 32, zippers 148 surrounding each arm hole 40, and a front zipper 26 extending from the face opening 28 to the garment's lower edge 24. The face shield 32 is shown with a section 138 comprising a porous screen or mesh. In an optional embodiment, the garment 10C is formed without the integral head covering 30C.

Turning now to FIGS. 28, 29 and 30, three exemplary removable arms 150 are illustrated, each having an upper opening 154 for joining to the torso portion 12. Several different hand coverings 20 are shown, and additional hand covering configurations as previously described herein in FIGS. 5–18 may be used. In FIG. 28, the distal end 66 of the arm 150 comprises a cuff 156 and a thumb hole 70 for achieving partial coverage of the wearer's hand, not shown. In FIG. 29, the cuff 156 includes a pair of Velcro® straps 158 to tighten the cuff about the wearer's wrist 123. In FIG. 30, a hand covering 20A comprises a versatile mitten as previously described and shown in FIG. 8, for example. Of course, various materials may be used to construct the arms 150 to achieve differing insulative value or to repel rain or snow, for example.

The variety of garments and garment elements described herein enable a desirable comfort level under widely ranging climatic conditions and activities. Each of the hand coverings and head coverings have various modes of wear whereby rapid changes in temperature, wind speed, or personal activity level may be accommodated rapidly and easily. Such changes may be made "on the run", i.e. without long pauses in activity.

It will be recognized from the above description that the various garment configurations of this invention enable a wearer to perform strenuous activities in greater comfort, safety and enjoyment than was previously attainable.

While the present invention has been disclosed herein in terms of certain exemplary embodiments, those of ordinary skill in the art will recognize and appreciate that it is not so limited. Many additions, deletions and modifications to the disclosed embodiments may be effected without departing from the scope of the invention. Moreover, features from one embodiment may be combined with features from other embodiments. The scope of the instant invention is only to be limited by the claims which follow.

What is claimed is:

1. A multi-mode hand covering for a person, comprising:

an elongate tubular portion having an inner space, a hand insertion end into which a person's hand may be inserted and a forward terminal end;

an opening in said terminal end through which said person's hand may be passed;

a palm side of said tube corresponding to a palm of said inserted hand;

a back side of said tube corresponding to a back side of said inserted hand;

a thumb enclosure extending outwardly from the palm side and communicating with said inner space for enclosing said person's thumb; and an exterior pocket extending generally from said terminal end to a pocket opening generally spanning said palm side proximate said thumb enclosure;

wherein said pocket is operable between a palm position wherein said terminal end opening is open to the atmosphere for passage of said person's hand therethrough for exposure thereof and wherein said thumb enclosure is positioned within said pocket, and a back position covering said terminal end opening whereby said hand is fully covered.

2. A multi-mode hand covering in accordance with claim 1, wherein said hand covering is convertible from a hand exposure mode to a hand covered mode by inverting said pocket.

3. A multi-mode hand covering in accordance with claim 1, wherein said thumb enclosure is configured to projecting hold said person's thumb without inverting said pocket to a hand covered mode, whereby said thumb enclosure limits general exposure to said person's fingertips wherein said upper hand portions and upper finger portions are covered.

4. A multi-mode hand covering in accordance with claim 1, further comprising a thumb hole through said hand covering at an intermediate location whereby said person's thumb is exposable independently of said fingers.

5. A multi-mode hand covering in accordance with claim 1, wherein said hand insertion end comprises a wrist opening of one of a glove and mitten.

6. A multi-mode hand covering in accordance with claim 5, wherein said wrist opening has folded panel ends and further comprising a cinch cord generally contained within said folded panel ends.

7. A multi-mode hand covering in accordance with claim 1, wherein said palm side and back side are configured to form finger portions for separately enclosing each said finger.

8. A multi-mode hand covering in accordance with claim 1, wherein said palm side and back side are configured to form at least one finger portion for enclosing at least two fingers.

9. A multi-mode hand covering in accordance with claim 1, wherein said hand covering comprises panels of a shell type material enclosing panels of insulative fleece type material.

10. A multi-mode hand covering in accordance with claim 9, wherein said shell type material comprises a PTFE® fabric.

11. A multi-mode hand covering in accordance with claim 1, wherein said hand insertion end comprises an arm of an upper body garment.

12. A multi-mode hand covering in accordance with claim 1, wherein said hand insertion end comprises a garment arm which is selectively detachable and attachable to an upper body garment.

* * * * *